United States Patent [19]

Weder

[11] Patent Number: 5,072,460

[45] Date of Patent: Dec. 17, 1991

[54] MASK ADAPTED TO BE PLACED OVER AT LEAST A PORTION OF AN INDIVIDUAL'S FACE

[75] Inventor: Andrew Weder, Highland, Ill.

[73] Assignee: Highland Supply Corporation, Highland, Ill.

[21] Appl. No.: 504,707

[22] Filed: Apr. 4, 1990

Related U.S. Application Data

[63] Continuation of Ser. No. 314,942, Feb. 24, 1989, abandoned.

[51] Int. Cl.[5] ..... A41G 7/00

[52] U.S. Cl. ..... 2/206; 156/227; 264/339

[58] Field of Search ..... 2/206, 173; 446/27; 156/227; 264/339

[56] References Cited

U.S. PATENT DOCUMENTS

| | | | |
|---|---|---|---|
| 2,028,206 | 1/1936 | Hall | 2/206 |
| 2,752,916 | 7/1956 | Haliczer | 2/206 |
| 3,106,041 | 10/1963 | Kahn | 2/206 |
| 3,439,447 | 4/1969 | Green | 446/27 |
| 4,015,327 | 4/1977 | McCarthy | 264/222 |
| 4,027,340 | 6/1977 | Hadtke | 446/27 |
| 4,199,538 | 4/1980 | Wu | 264/320 |
| 4,397,701 | 8/1983 | Johnson et al. | 2/206 |
| 4,690,653 | 9/1987 | Goldberg | 446/27 |
| 4,773,182 | 9/1988 | Weder et al. | 428/35 |
| 4,827,924 | 5/1989 | Japuntich | 128/206.16 |

FOREIGN PATENT DOCUMENTS

| | | | |
|---|---|---|---|
| 2935105 | 3/1981 | Fed. Rep. of Germany | 264/320 |
| 81/03266 | 11/1981 | World Int. Prop. O. | 128/206.19 |

OTHER PUBLICATIONS

Brochure—Highland Supply Corporation, Cpy. 1989, SPEED COVER.

*Primary Examiner*—James Lowe

*Attorney, Agent, or Firm*—Dunlap, Codding, Peterson & Lee

[57] ABSTRACT

A method for forming a mask to be placed over at least a portion of an individual's face wherein a plurality of overlapping folds are formed in the sheet of material while the sheet of material is formed into the mask shape, the overlapping fold cooperating to maintain the sheet of material in the formed, predetermined mask shape.

7 Claims, 1 Drawing Sheet

MASK ADAPTED TO BE PLACED OVER AT LEAST A PORTION OF AN INDIVIDUAL'S FACE

This is a continuation of co-ending application Ser. No. 314,942 filed on Feb. 24, 1989, entitled "A MASK ADAPTED TO BE PLACED OVER AT LEAST A PORTION OF AN INDIVIDUAL'S FACE" and now abandoned.

FIELD OF THE INVENTION

The present invention relates generally to a mask for placing over at least a portion of an individual's face made by forming a sheet of material into the form of the mask by forming overlapping folds in the material wherein the overlapping folds cooperate to maintain the sheet of material formed in the predetermined mask shape.

DESCRIPTION OF THE PREFERRED EMBODIMENTS

Figure 1:
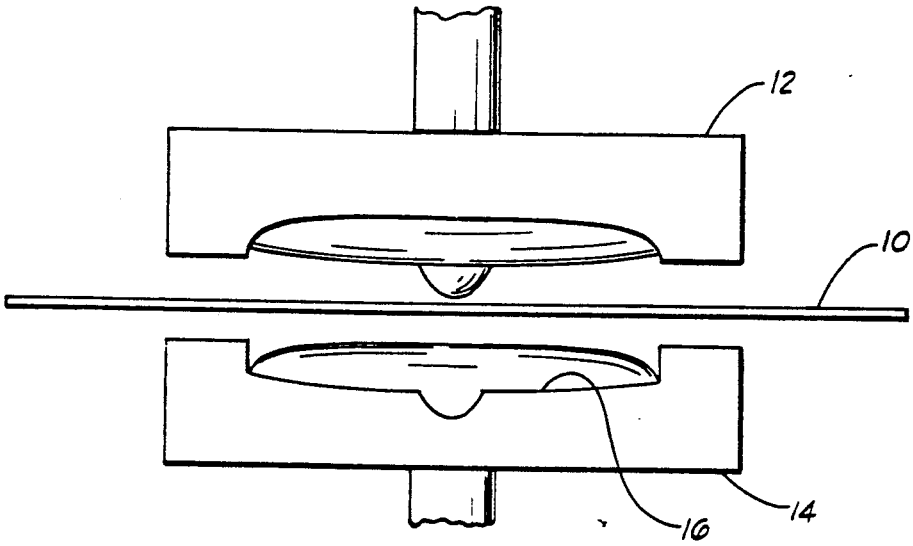
FIG. 1 is a view illustrating the forming of the mask of the present invention between a male and a female die.
Figure 2:
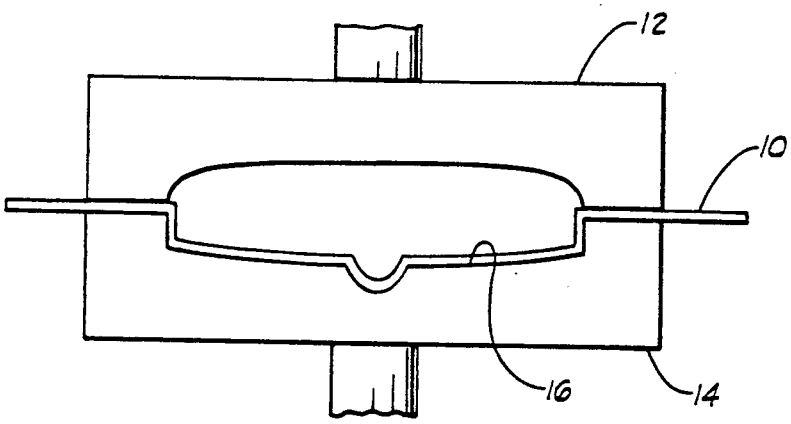
FIG. 2 is a view similar to FIG. 1 illustrating the forming of the mask of the present invention generally between a modified male and a female die.

The present invention generally comprises a mask which is adapted to cover at least a portion of an individual and which is formed by placing a sheet of material 10 generally between a male die 12 and a female die 14, as generally shown in FIG. 1. The male die 12 has a die surface 16 formed in a central portion thereof and the female die 14 has a die surface 18 formed generally in a central portion thereof. The die surface 18 is shaped to matingly engage the die surface 16 when the male and the female die 12 and 14 are brought into mating engagement. The die surfaces 16 and 18 are shaped such that the formed shape of the mask conforms to a predetermined formed mask shape.

Figure 3:
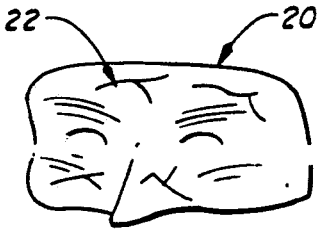
FIG. 3 is a view of a mask formed in accordance with the present invention adapted to cover only the area of an individual's face generally about and near the eyes of the individual.
Figure 4:
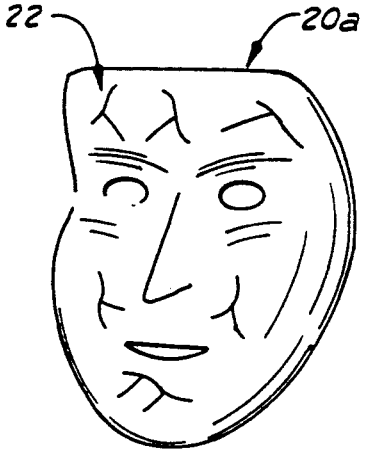
FIG. 4 is a view of another mask constructed in accordance with the present invention adapted to cover generally the entire face portion of an individual.

The formed mask of the present invention particularly is adapted to cover at least a portion of an individual's face in use. For example, the formed mask shape 20 shown in FIG. 3 is shaped and adapted to cover only the portion of an individual's face generally near and about the area of an individual's eye and the formed mask 20*a* shown in FIG. 4 is adapted and shaped generally to cover the entire front face portion of an individual.

During the forming of the mask 20 or 20*a*, the sheet of material is placed between the male and the female die 12 and 14. The male and the female die 12 and 14 are brought into mating engagement. As the male and the female die 12 and 14 are brought into mating engagement, the sheet of material 10 is compressed generally between the die surfaces 16 and 18 and overlapping folds 22 (only some of the overlapping folds 22 being generally designated by a reference numeral in FIGS. 3 and 4) are formed in the sheet of material. The formed article contains a plurality of overlapping folds 22 and the overlapping folds 22 each are of varying lengths and each extend at different varying angles over the surface of the formed mask shaped 20 or 20*a*. The overlapping folds 22 cooperate to contribute to the rigidity of the formed mask shape 20 or 20*a* for cooperating intending to maintain the formed shape of the formed mask shape 20 or 20*a*. The overlapping folds may be sealingly connected by use of an adhesive or by applying heat via the male and the female dies 12 and 14 to the sheet of material 10 during the forming process or combinations thereof.

The sheet of material 10 is a relatively thin, flexible sheet of material having a thickness in a range from less than about 1.5 mils to about 10 mils, although the upper limit of the range of the thickness could be as high as 30 mils depending upon the precise type of material used to construct the sheet of material. The upper limit on the thickness of the sheet of the material may vary depending on the type of material utilized. Preferably, the upper limit of the thickness of the sheet of material is about 30 mils.

The sheet of material 10 is constructed of a material selected from a group of material comprising paper, cellophane, foil or processed organic polymer films or combinations thereof.

In one preferred embodiment, the sheet of material is constructed for relatively thin, flexible film of substantially non-shaped sustaining processed organic polymer film. The term "processed organic polymer film" as used herein means a man-made resin such as a polypropolyene as opposed to naturally occurring resins such as a cellophane. A processed organic polymer film is relatively strong and not as subject to tearing (substantially non-tearable) as might be the case with paper or foil for example.

In form, the formed mask shape 20 or 20*a* is substantially flexible and maintains this flexibility after the forming process.

A decorative pattern may be applied to the inner surface and/or the outer surface of the formed mask shape 20 or 20*a* to contribute to the ornamental appearance of the mask.

The mask 20 or 20*a* may be formed from a single sheet of material or from a plurality of sheets of material. When formed from a plurality of sheets of material, the sheets preferably are laminated prior to the forming step.

Changes may be made in the various elements as described herein, or in the steps of the method described herein, or in the sequence of the steps of the methods described herein without departing from the spirit and the scope of the invention as defined in the following claims.

What is claimed is:

1. A flexible face mask having a predetermined shape comprising a flexible sheet material having a thickness in a range from less than about 1.5 mils to about 30 mils and including a plurality of overlapping folds of varying lengths which extend at varying angles over the mask surface and cooperatively maintain said flexible sheet material in said predetermined shape yet substantially flexible.

2. The flexible face mask of claim 1 wherein the sheet of flexible material is defined further as being constructed of a material selected from the group of materials consisting of a man-made organic polymer film, cellophane and paper.

3. The flexible face mask of claim 1 wherein the sheet of material has a thickness in a range from less than about 1.5 mils to about 10 mils.

4. The flexible face mask of claim 1 wherein the sheet of material is a man-made organic polymer film.

5. The flexible face mask of claim 1 wherein said plurality of overlapping folds are sealingly connected.

6. The flexible face mask of claim 5 wherein said plurality of overlapping folds are sealingly connected by an adhesive.

7. The flexible face mask of claim 5 wherein said plurality of overlapping folds are sealingly connected by a heat seal.

* * * * *